US005181048A

United States Patent [19]

Cha

[11] Patent Number: 5,181,048

[45] Date of Patent: Jan. 19, 1993

[54] PREHEATED THERMAL PRINT APPARATUS FOR VIDEO PRINTER

[75] Inventor: Dong-il Cha, Kyunggi-do, Rep. of Korea

[73] Assignee: Samsung Electronics Co., Ltd., Kyungki, Rep. of Korea

[21] Appl. No.: 753,389

[22] Filed: Aug. 30, 1991

[30] Foreign Application Priority Data

Aug. 31, 1990 [KR] Rep. of Korea ..... 90-13676

[51] Int. Cl.[5] ..... B41J 2/38

[52] U.S. Cl. ..... 346/76 PH

[58] Field of Search ..... 346/76 PH; 400/120; 358/298

[56] References Cited

FOREIGN PATENT DOCUMENTS 201681 11/1983 Japan .
149463 7/1987 Japan .
51158 3/1988 Japan .
270573 11/1990 Japan .

*Primary Examiner*—Joseph W. Hartary
*Assistant Examiner*—Scott A. Rogers
*Attorney, Agent, or Firm*—Robert E. Bushnell

[57] ABSTRACT

A preheating printing apparatus includes a thermal print head, an input port, a memory, a gradation counter, a comparator, a thermal driving signal generator, a controller, a preheating signal generator, and a control switch. The apparatus can drive the thermal print head with electrically economical thermal elements and improved printing quality, by printing after preheating the thermal print head while video data is stored in line memory.

18 Claims, 5 Drawing Sheets

PREHEATED THERMAL PRINT APPARATUS FOR VIDEO PRINTER

BACKGROUND OF THE INVENTION

The present invention relates to a video printer for printing a video information onto paper, and more particularly to a preheat-type video printer which improves picture quality by preheating a thermal print head when storing data to a line memory.

A video printer prints a picture recorded by the instantaneous capture of a video signal, or an image which is reproduced on a monitor and was recorded by a still camera or the like. FIG. 1 is a block diagram of a video printer.

Referring to FIG. 1, a decoder 10 separates the R(red), G(green), and B(blue) analog signals from a video signal input from a first input port 5, and supplies them to an analog-to-digital (A/D) converter 20. The decoder 10 also separates the horizontal and vertical synchronous H sync and V sync signals from the video signal received via the first input port 5, and supplies them to a memory controller 70, which, upon receiving a memory instruction from a second input port 15, generates sampling pulses synchronized by the H and V sync signals from decoder 10 and supplies the same to A/D converter 20. The memory controller 70 also generates a write address and supplies it to a frame memory 30. The A/D converter 20 quantizes each of the R, G, and B analog signals from decoder 10 according to a sampling pulse train generated from memory controller 70, and encodes the quantized analog signals into digital signals. Since the video signal's transmission speed differs from its print speed, frame memory 30 stores R, G, and B digital signals from A/D converter 20 in its own storage locations corresponding to the write address from memory controller 70. When the video signal of a frame is fully stored in frame memory 30, memory controller 70 terminates the control for storing video signal.

Upon receiving a print instruction signal from a third input port 25, a print controller 80 simultaneously applies a read address to frame memory 30 and a write address to a line memory 31. At the same, print controller 80 also supplies a selection control signal to a memory selection switch 40 which sequentially selects one of the digital R, G and B signals from frame memory 30 in accordance with the selection control signal. This selected digital color signal output by memory selection switch 40 is supplied to a line memory 31 which stores a line of the digital color signal in its own storage locations corresponding to the write address output from print controller 80. Under control of print controller 80, each line of the digital color signal stored in line memory 31 is supplied to a controller 50.

The controller 50 sequentially converts the digital R, G, and B signals from line memory 31 to Y(yellow), M(magenta), and C(cyan) signals respectively and at the same time, performs resistance correction to reduce the resistive deviation of each thermal element of the print head and also performs color correction to compensate for the error of density conversion in accordance with the correlation between the properties of the particular paper in use and the amount of heat which the print head generates. Then, the controller 50 applies the converted and compensated Y, M, and C signals as thermal data to the print head of printer 60 to print one line at a time repeatedly, thereby completing the printing of one frame.

FIG. 2 is a timing diagram for carrying out video printing in a conventional video printer. The odd vertical scan period shown on the left in FIG. 2 corresponds to a line memory period during which line memory 31 stores one column data of a video signal to print onto paper. The even vertical scan period shown on the right in FIG. 2 is a printing period during which controller 50 processes the column data stored in line memory 31 to print the same onto paper by the print head of printer 60. During the line memory period, print controller 80 supplies a control signal to a power driving means, e.g., a brushless DC motor in the printer 60, which locks the motor during printing.

FIG. 3 is a block diagram of a conventional thermal printing apparatus for a video printer. Here, an input port 105 receives the digital video data from the frame memory 30 of FIG. 1 during the line memory period shown in FIG. 2. Referring to FIG. 3, line memory 31 stores and maintains one column data until one line has completed printing under the control of a controller 110. A command from controller 110 instructs the video data stored in line memory 31 to be supplied to comparator 120 which compares the video data with the count value from a gradation counter 100, and detects print samples by their gray levels. For the print samples, the video data is equal to the count value of gradation counter 100, establishing the output of comparator 120 as a logic HIGH. Comparator 120 supplies the print designation data for each detected sample to a shift register 191.

A temperature detector 140 detects the temperature of a thermal element, and supplies the detected temperature data to a gradation ROM 130. Gradation read only memory (ROM) 130 receives the temperature data from temperature detector 140 and the count value from the gradation counter 100 and reads out intensity/time data which is stored in locations corresponding to the count value from gradation counter 100 and temperature data from the temperature detector 140, and supplies it to a pulse-width modulated (PWM) signal generator 160. A reference pulse train of a constant frequency generated in a pulse generator 150 is supplied to the PWM signal generator 160 which uses the reference pulses to pulse-width modulate the intensity/time data from gradation ROM 130, and supplies the modulated PWM signal to a decoder 170 which in turn supplies a thermal element driving signal to a thermal element driver 193. During the pulse period of the PWM signal, the thermal element driving signal has constant voltage or current.

A shift register 191 serially receives the print designation data for each sample from comparator 120 according to the control clock from controller 110, and supplies each sample of the input print designation data in parallel to a latch 192. When a latch pulse is applied from a latch pulse generator 180 which is driven by controller 110, latch 192 transmits the print designation data for each sample in parallel from shift register 191 to a thermal driver 193. The thermal driver 193 applies thermal element driving signal from decoder 170 to thermal elements of the thermal element array 194 corresponding to the sample wherein the value of print designation data is "1" so that a thermal element array 194 performs the printing of the first gray level. When printing up to the 64th gray level according to the first gray level printing, the conventional thermal printing apparatus completes the printing of one column. A printing head 190 consists of the shift register 191, latch 192, thermal driver 193, and thermal element array 194.

Since the printing time of the conventional thermal printing apparatus for a video printer shown in FIG. 3 takes 1/60th of a second, the apparatus should increase the heat to the thermal elements in order to promote the intensity expression for 1/60th of a second. Thus, to increase the generated heat to the thermal elements, the instantaneous value of power according to the heat generating capacity must be increased, a large capacity semiconductor device must be employed as the semiconductor device of a thermal element driver, and the thermal elements must have high internal voltage.

SUMMARY OF THE INVENTION

Therefore, it is an object of the present invention to provide a preheated print apparatus for a video printer which improves printing quality with an electrically economical thermal print head by preheating the thermal print head while video data is stored in a line memory.

To attain the object, the preheated print apparatus of the present invention includes a thermal print head having thermal elements, an input port for inputting video data, a memory for temporarily storing one line of video data among the video data at the input port, a gradation counter for counting a print level designation value, a comparator for comparing the counted value from the gradation counter with the video data from the memory and supplying the compared print designation signal to the thermal print head, a thermal element driving signal generator for generating a thermal driving signal corresponding to the counted value from the gradation counter, a controller for controlling the memory, the gradation counter and the thermal print head, a preheating signal generator for generating a preheating signal under control of the controller, and a control switch for switching the thermal element driving signal or the preheating signal to the thermal print head under control of the controller.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
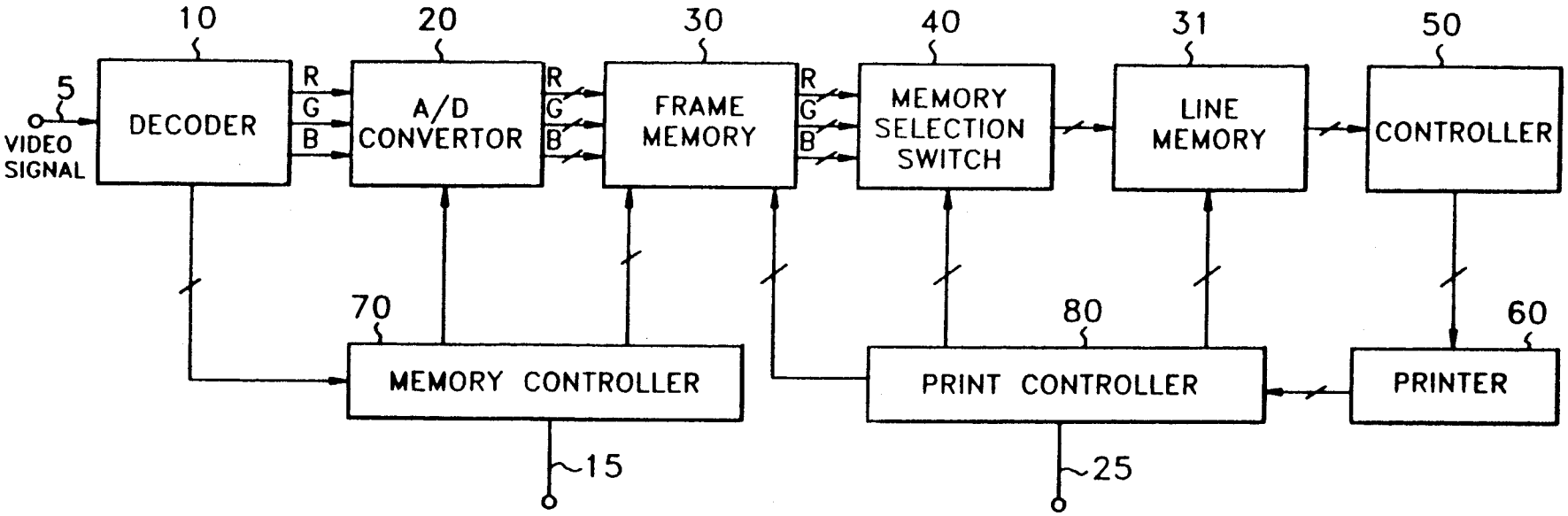
FIG. 1 (PRIOR ART)
FIG. 1 is a block diagram of an ordinary video printer.
Figure 2:
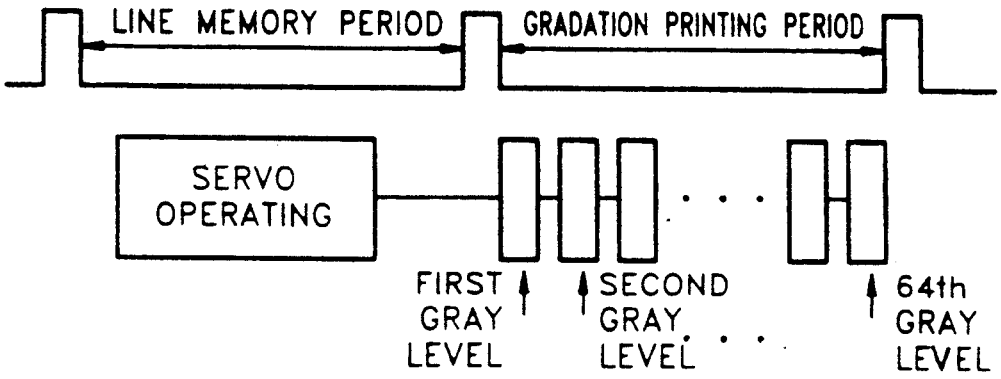
FIG. 2 (PRIOR ART)
FIG. 2 is a timing diagram for printing in the conventional video printer.
Figure 4:
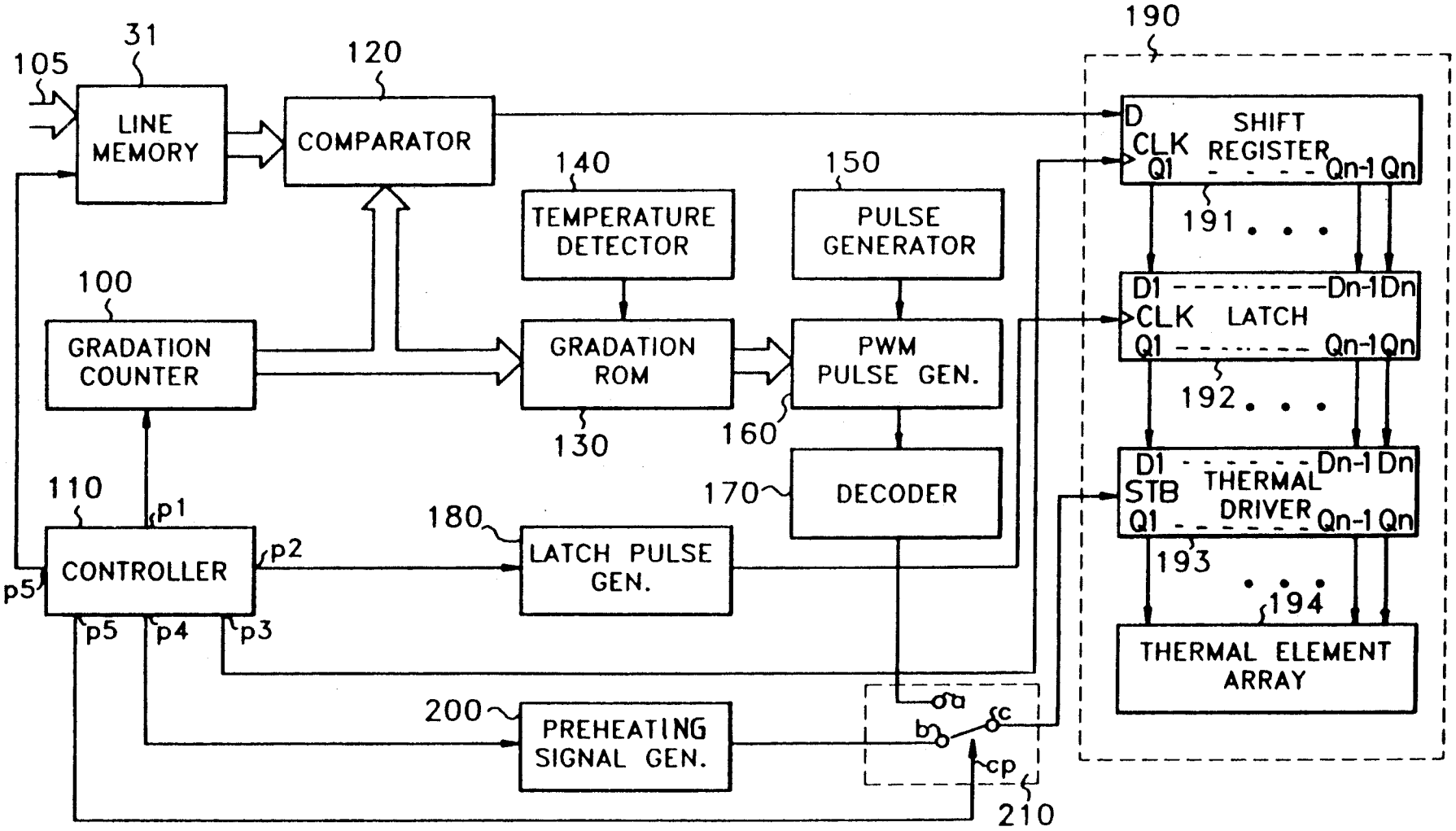
FIG. 4 is a block diagram of a preheating printer according to the present invention.

Referring to FIG. 4, input port 105 receives video data from the frame memory 30 shown in FIG. 1. In FIG. 4, input port 105 is coupled to line memory 31 whose control port receives commands from a first output port P0 of controller 110, and whose output is coupled to a first input of comparator 120. The input of gradation counter 100 is coupled to a second output port P1 of controller 110, while its output is simultaneously supplied to a second input of comparator 120 and a first input of gradation ROM 130. The output of comparator 120 is coupled to a data input port D of shift register 191. The output of temperature detector 140 is coupled to the second input of gradation ROM 130 whose output is coupled to the first input of PWM signal generator 160. The output of pulse generator 150 supplies a the second input of PWM signal generator 160 which in turn provides the input of decoder 170. The output of decoder 170 is connected to a first contact point (a) of a control switch 210. The input of latch pulse generator 180 receives commands from a third output P2 of controller 110, while a fifth output port P4 of controller 110 is connected to a preheating signal generator 200. The output of preheating signal generator 200 is coupled to second contact point (b) of control switch 210 whose control port CP is connected to a sixth output port P5 of controller 110. The output of latch pulse generator 180 is coupled to the clock port CLK of latch 192, while a fourth output port P3 of controller 110 is coupled to the clock port CLK of shift register 191. A reference point C of control switch 210 is coupled to a strobe port STB of thermal element driver 193. Output ports Q1–Qn from shift register 191 are coupled to input ports D1–Dn of latch 192, respectively, and in turn the output ports Q1–Qn from latch 192 are coupled to input ports D1–Dn of thermal element driver 193, respectively. The output ports Q1–Qn of thermal element driver 193 are coupled to the input ports D1–Dn of thermal element array 194, respectively.

Figure 5:
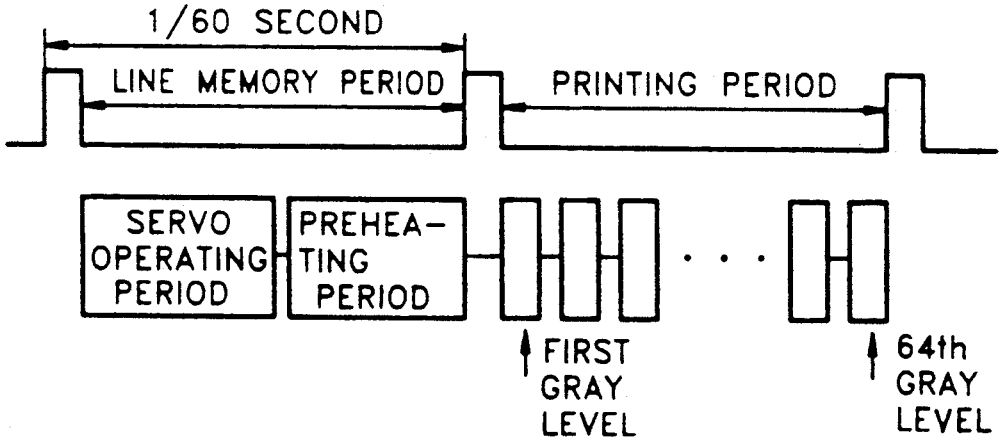
FIG. 5 is a printing timing diagram for printing in the preheating printer according to the present invention.
Figure 6:
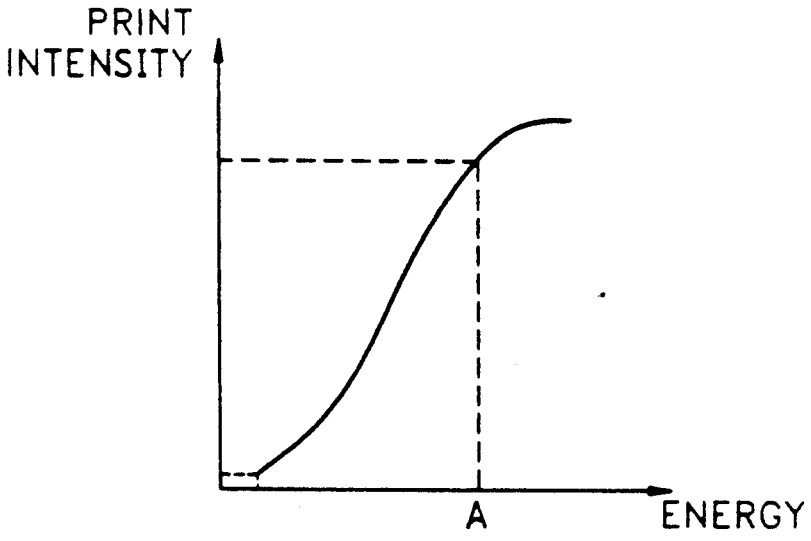
FIG. 6 is a characteristic curve of energy to print intensity of the thermal element array shown in FIG. 4.

A detailed description of the operation of the apparatus of the present invention follows with reference to FIGS. 4, 5 and 6.

When a print instruction is initiated by a user, controller 110 drives line memory 31 during the line memory period, i.e., the odd vertical scan period shown on the left in FIG. 5, so that line memory 31 stores video data input via input port 105. Then, also represented in FIG. 5, controller 110 preheats a thermal element during a preheating period subsequent to a servo period.

The preheating of thermal array 194 by controller 110 is accomplished as follows. Controller 110 resets gradation counter 100 to "0" via second port P1. The controller 110 also outputs driving signals via third and fifth output ports P2 and P4 to drive latch pulse generator 180 and preheating signal generator 200, respectively. Via fourth port P3, controller 110 further supplies a shift clock of a predetermined period to the clock port of shift register 191 for a certain time, and via sixth output port P5, supplies either HIGH or LOW logic as a switch control signal to control port CP of control switch 210. The predetermined time is set between the starting position of preheating interval and the end position of servo operating interval.

Under the control of the controller 110, the line memory 31 stores the video data received via input port 105 but does not output video data to the comparator 120. Therefore, the logic value of the video data supplied from line memory 31 to the first input of comparator 120 becomes "0". With the "0" value video data from line memory 31 and a "0" count value from gradation counter 100, the comparator 120 outputs a logic "1" as the print designation data to input port D of shift register 191.

The shift clock train supplied from the fourth output port P3 to the clock port CLK of shift register 191 serially shifts the print designation data from comparator 120 into data input port D, and outputs the shifted data through ports Q1–Qn in parallel to their respective input ports D1–Dn of latch 192. When the clock port of the latch 192 receives a latch pulse from latch pulse generator 180, data from the output ports Q1–Qn of shift register 191 is supplied to input ports D1–Dn of thermal element driver 193 via respective inputs and outputs of the latch 192.

Preheating signal generator 200 generates a preheating signal under the control of controller 110 and supplies its output signal to contact point (b) of control switch 210. When reference contact point (c) is in contact with point b according to the logic state of a switch control signal supplied from sixth output port P5 of controller 110 to control port CP, control switch 210 transmits the preheating signal from preheating signal generator 200 to strobe port STB of thermal element driver 193 during the time from the end of servo operation interval to the end of the line memory period.

According to the print designation data bits having the logic value "1" and supplied from each output port Q1–Qn of latch 192 to input ports D1–Dn, thermal driver 193 supplies the preheating signal from control switch 210 to each thermal element of thermal array 194 via output ports Q1–Qn.

Each thermal element of thermal array 194 is preheated by the preheating signal from thermal driver 193. The rise of temperature of the color ribbon and paper (not shown) due to the heat from preheated thermal element array 194 shortens the time required to generate the basic energy required to sublimate colors during printing for gray levels. The basic energy is that which corresponds to a point A shown in FIG. 6. Therefore, by shortening the time required to generate basic energy, printing all the gray levels is possible within 1/60th of a second.

Figure 3:
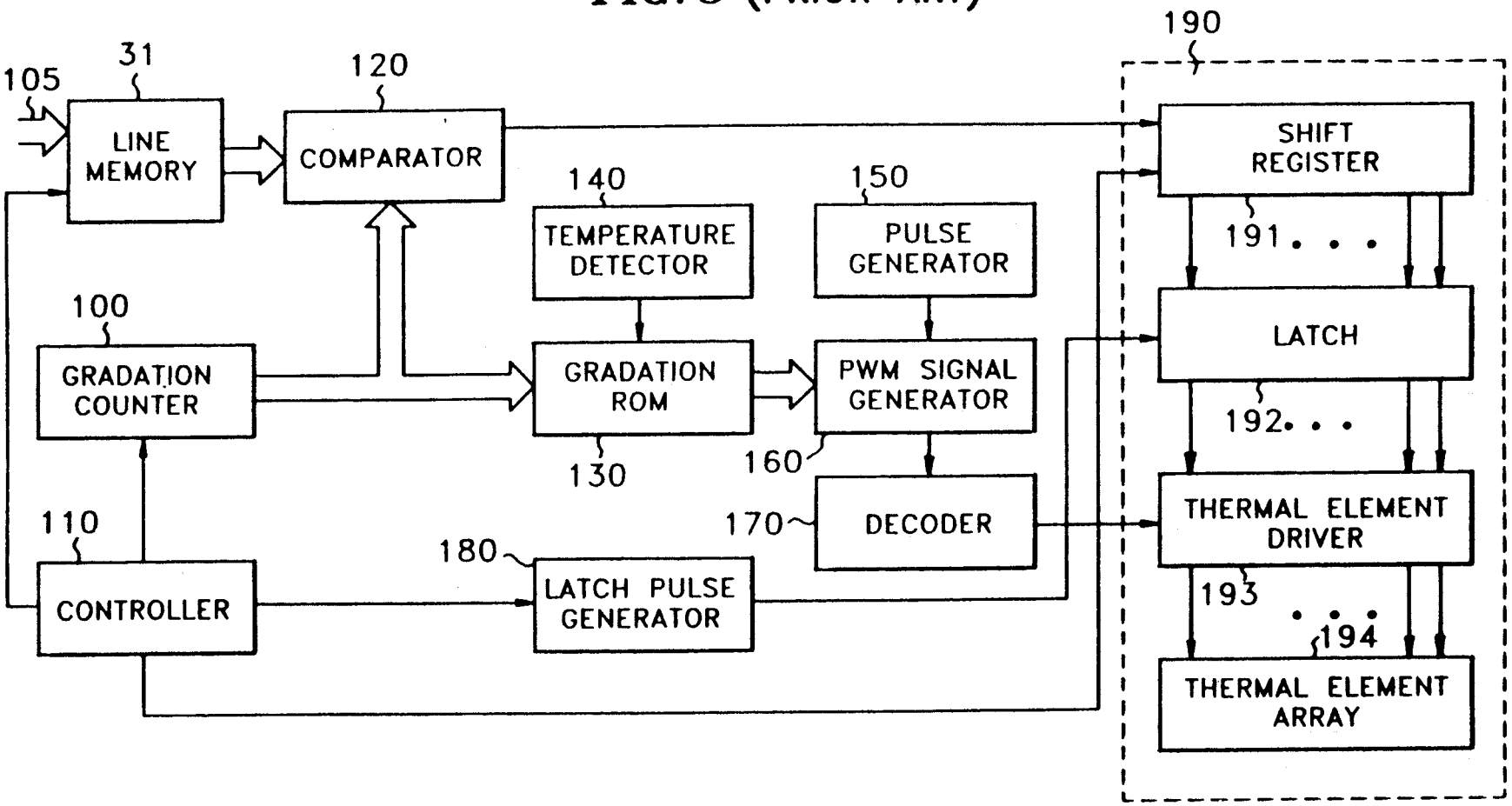
FIG. 3 (PRIOR ART)
FIG. 3 is a block diagram of a thermal printing device of the conventional video printer.

After preheating the thermal elements in the preheating printing device shown in FIG. 4, gray level printing during the printing period of the even vertical scan period shown on the right in FIG. 5, is carried out in the same manner as described in reference to FIG. 3, except that reference contact point (c) of control switch 210 in FIG. 4 is switched to contact point (a) according to the logic state of the switching control signal from controller 110 applied to control port CP so that control switch 210 delivers the output of decoder 170 as a thermal driving signal to strobe port STB of thermal driver 193.

As described above in detail, the present invention can drive a thermal print head with electrically economical thermal elements and improve printing quality, by printing after preheating the thermal print head while video data is stored in line memory.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A preheated thermal print apparatus for a video printer having a thermal print head, comprising:

an input port for inputting video data on a line-by-line basis;

a memory for temporarily storing single lines of video data among the video data received via said input port;

a gradation counter for generating an output by counting a print level designation value to sequentially designate gradations to be printed;

a comparator for comparing the output of said gradation counter with the video data from said memory to produce print signals, and for supplying said print signals to said thermal print head;

thermal element driving signal generating means for generating a thermal element driving signal corresponding to the output of said gradation counter;

a controller for controlling said memory, said gradation counter and the thermal print head, thereby enabling generation of a fundamental energy for sublimating dye materials by said thermal print head during a line memory period while each line of video data in stores in said memory; and a control switch for responding to said controller by enabling transmission of one of said thermal element driving signal and said fundamental energy to the thermal print head.

2. The preheated thermal print apparatus as claimed in claim 1, further comprised of a preheating signal generator for generating said fundamental energy for a preheating period occurring during a first period while a corresponding line of said video data is stored in said memory prior to printing of symbols representative of said print signals by the thermal print head during a second period.

3. The preheated thermal print apparatus as claimed in claim 1, wherein said control switch selects said fundamental energy for a preheating period occurring during a first period while a corresponding line of said video data is stored in said memory prior to printing of symbols representative of said printing signals by the thermal print head during a second period.

4. A preheated thermal print apparatus having a thermal print head, comprising:

memory means for receiving video signals to provide printing signals on a line-by-line basis;

preheating signal generator means for generating preheating signals for a preheating period; and switch means for receiving said preheating signals and each line of said printing signals, for providing transmission of said preheating signals to the thermal print head for heating said thermal print head for said preheating period, and for providing transmission of said printing signals to the thermal print head to enable printing of symbols representative of said printing signals by said thermal print head on a printable medium during a printing period.

5. The preheated thermal print apparatus as claimed in claim 4, wherein said preheating signal generator means generates preheating signals for said preheating period occurring during a first period while each line of said video signals is stored in said memory means prior to printing each line of said printing signals during a second period.

6. The preheated thermal print apparatus as claimed in claim 4, wherein said switch means selects said preheating signals for said preheating period occurring during a first period while each line of said video signals is stored in said memory means prior to printing each line of said printing signals during a second period.

7. A preheated thermal print apparatus, comprising:

input means for receiving video signals on a line-by-line basis, each line of said video signals having a first period, and for providing printing signals on a line-by-line basis from said video signals;

preheating signal generator means for generating preheating signals for a preheating period during said first period; and thermal print head means for printing symbols representative of said printing signals on a printable medium, said thermal print head having a register for storing each line of said printing signals, and an array of thermal elements coupled to receive thermal energy in dependence upon said preheating signals for said preheating period during said first period prior to printing each line of said printing signals during a second period occurring subsequently to said first period.

8. The preheated thermal print apparatus as claimed in claim 7, wherein said preheating signal generator means generates preheating signals for said preheating period occurring during said first period while each line of video signals is received by said input means on a line-by-line basis prior to printing each line of said printing signals during said second period.

9. The preheated thermal print apparatus as claimed in claim 7, further comprising switch means for responding to a controller by enabling transmission of one of said preheating signals during said preheating period occurring during said first period and said printing signals on a line-by-line basis during said second period.

10. A preheated thermal print apparatus having a thermal print head comprising an array of thermal elements for printing video signals on a printable medium, said preheated thermal print apparatus comprising:

means for receiving video signals on a line-by-line basis;

first memory means for temporarily storing single lines of video signals received on a line-by-line basis, each of said lines of video signals having a line memory period;

gradation counter means for counting a predetermined gradation level of said video signals to provide print gradation data;

comparator means for generating printing signals in dependence upon comparison of each line of said video signals with corresponding print gradation data;

temperature detector means for detecting a temperature of said array of thermal elements of said thermal print head to provide temperature data;

second memory means for receiving said print gradation data and said detected temperature data to provide intensity/time data in dependence upon said print gradation data;

generator means for generating modulated signals by pulse-with modulating said intensity/time data in dependence upon a reference pulse train;

decoder means for decoding said modulated signals to provide thermal element driving signals;

preheating signal generator means for generating preheating signals; and switching means for enabling transmission of one of said thermal element driving signals and said preheating signals to the thermal print head in response to a controller.

11. The preheated thermal print apparatus as claimed in claim 10, wherein said preheating signal generator means generates preheating signals for a preheating period occurring during a first period while said first memory means stores each line of video signals prior to the thermal print head printing symbols representative of each line of said printing signals during a second period.

12. The preheated thermal print apparatus as claimed in claim 10, wherein said switching means selects said preheating signals for a preheating period occurring during a first period while said first memory means stores each line of video signals prior to enabling transmission of each line of said printing signals to the thermal print head during a second period.

13. A preheated thermal print apparatus having a thermal print head for sublimating dye materials on a printable medium, said preheated thermal print apparatus comprising:

memory means for receiving video signals to provide printing signals on a line-by-line basis;

preheating signal generator means for generating preheating signals for a preheating period; and switch means for receiving each line of said printing signals and said preheating signals for providing transmission of said preheating signals to the thermal print head for providing fundamental energy to said thermal print head for sublimating dye materials during said preheating period, and for providing transmission of said printing signals to the thermal print head for printing symbols representative of said printing signals by said thermal print head onto said printable medium during for a printing period.

14. The preheated thermal print apparatus as claimed in claim 13, wherein said preheating signal generator means generates preheating signals for said preheating period occurring during a first period while each line of said video signals is stored in said memory means prior to printing each line of said printing signals during a second period, and said preheating signal representing said fundamental energy for sublimating said dye materials for said thermal print head to print each line of said printing signals.

15. The preheated thermal print apparatus as claimed in claim 13, wherein said switch means selects said preheating signals for said preheating period occurring during a first period while each line of said video signals is stored in said memory means prior to printing each line of said printing signals during a second period.

16. A preheated thermal print apparatus, comprising:

means for receiving video signals on a line-by-line basis, each line of said video signals having a first period, and for providing printing signals on a line-by-line basis from said video signals;

preheating signal generator means for generating preheating signals for a preheating period during said first period, said preheating signals representing a fundamental energy; and thermal print head means for printing symbols representative of said printing signals on a printable medium, said thermal print head having a register for storing each line of said printing signals, and an array of thermal elements coupled to receive said preheating signals for sublimating dye materials representative of color components in dependence upon reception of said preheating signals for said preheating period during said first period prior to printing each line of said printing signals during a second period occurring subsequent to said first period.

17. The preheated thermal print apparatus as claimed in claim 16, wherein said preheating signal generator means generates preheating signals for said preheating period occurring during said first period while each line of video signals is received by said means for providing printing signals on a line-by-line basis prior to printing each line of said printing signals during said second period.

18. The preheated thermal print apparatus as claimed in claim 16, further comprising switch means for responding to a controller by enabling transmission of one of said preheating signals for said preheating period occurring during said first period, and said printing signals on a line-by-line basis during said second period.

* * * * *

UNITED STATES PATENT AND TRADEMARK OFFICE

CERTIFICATE OF CORRECTION

PATENT NO. : 5,181,048

DATED : January 19, 1993

INVENTOR(S) : Dong-Il Cha

It is certified that error appears in the above-indentified patent and that said Letters Patent is hereby corrected as shown below:

Column 6

Claim. 1 Line 19, after "data", change "in stores" to -- is stored --;

Column 8

Claim 13 Line 30, after "during", delete "for":

Signed and Sealed this

Seventeenth Day of October, 1995

Bruce Lehman

*Attest:*

BRUCE LEHMAN

*Attesting Officer*

*Commissioner of Patents and Trademarks*